US005103611A

United States Patent [19]

Takeda

[11] Patent Number: 5,103,611

[45] Date of Patent: Apr. 14, 1992

[54] PANEL UNIT

[75] Inventor: Akihiko Takeda, Tokyo, Japan

[73] Assignee: Yoshida Kogyo K. K., Tokyo, Japan

[21] Appl. No.: 754,175

[22] Filed: Aug. 27, 1991

Related U.S. Application Data

[63] Continuation of Ser. No. 457,573, Dec. 27, 1989, abandoned.

[30] Foreign Application Priority Data

Dec. 28, 1988 [JP] Japan ..... 63-168205[U]

[51] Int. Cl.[5] ..... E04B 1/24

[52] U.S. Cl. ..... 52/235

[58] Field of Search ..... 52/235, 204, 208

[56] References Cited

U.S. PATENT DOCUMENTS 3,678,625 7/1972 Vance ..... 52/207

4,545,161 10/1985 Baumann ..... 52/235

4,866,896 9/1989 Shreiner ..... 52/235

*Primary Examiner*—John E. Murtagh

*Attorney, Agent, or Firm*—Hill, Van Santen, Steadman & Simpson

[57] ABSTRACT

A panel unit comprising: a plurality of frame portions formed by dividing a main framework, assembled in rectangle, by means of at least one intermediate connecting member; first panel sections mounted on respective outdoor sides of some of the panel portions so as to form outdoor-side panel mounted surfaces flushed with one another; remaining frame portions each having a recessed portion recessed toward the indoor side relative to the panel mounted surfaces; auxiliary frame portions each being mounted to the recessed portion; and second panel portions mounted on respective outdoor sides of the auxiliary frame portions so as to form smooth surfaces flushed with the panel mounted surfaces of the first panel sections, wherein predetermined jointing spaces having equal lateral widths to one another are formed between respective panel sections adjacent to each other.

11 Claims, 7 Drawing Sheets

PANEL UNIT

This is a continuation of application Ser. No. 457,573, filed Dec. 27, 1989, now abandoned.

BACKGROUND OF THE INVENTION

1. Field of the Invention

This invention relates to panel units connected vertically and horizontally on the same surface thereby forming an external wall of a building or the like.

2. Description of the Prior Art

There are so far known a plurality of panel units mounted on the front surface of a building so as to form an external wall of the building as shown in Japanese Laid-open Patent Application No. 61-2133, each of these panel units comprising a rectangular framework formed by an upper rail, a lower rail, and left and right stiles, the framework having glass plates and panels, etc. mounted thereon.

Since such a panel is comprised of one piece of framework having one piece of panel mounted thereon, in order to form an external wall of a building, it is necessary to mount a plurality of panel units continuously in the vertical and horizontal directions.

Whilst, it is important from the point of view of external appearance to position the panel units to a building body in the vertical and horizontal directions, and align rectilinearly the jointing spaces each having the same width and formed between adjacent panel units, which are connected continuously in the vertical and horizontal directions.

Therefore, the operations of positioning and mounting a plurality of panel units on the outer surface of a building become very troublesome, and also since sealing members are mounted in the jointing spaces formed between the adjacent panel units at site, not only the operation of mounting the sealing members becomes very troublesome, but also the reliability of the operation will deteriorate.

SUMMARY OF THE INVENTION

The present invention has been devised in view of the above-mentioned circumstances in the prior art, and has for its object to provide a panel unit wherein a framework is formed by a plurality of frame portions, and each of the frame portions has a plurality of panels mounted thereon and spaced apart with one another by a predetermined jointing space in such a manner that the difficulties and disadvantages incidental to the above-mentioned prior art can be eliminated and the operations of mounting panel units and attaching sealing members can be carried out reliably and readily.

To achieve the above-mentioned object, according to an aspect of the present invention, there is provided a panel unit comprising: (a) a rectangular main framework formed by a pair of left and right stiles extending vertically in parallel relationship and spaced apart horizontally with each other, a pair of upper and lower rails connected horizontally between the upper portions of the stiles and between the lower portions thereof, respectively, and a pair of first and second intermediate rails, respectively, connected horizontally between the pair of left and right stiles and at vertically substantially intermediate positions between the upper and lower rails, the outer surfaces of the first and second intermediate rails having portions located opposite to and flush with the outer surfaces of the upper and lower rails, respectively, and recessed portions located opposite to each other; (b) a rectangular auxiliary frame formed by a pair of left and right auxiliary stiles, respectively, located on the outer surface of the pair of left and right stiles, an upper auxiliary rail connected between the upper portions of the pair of auxiliary stiles and mounted on the recessed outer surface of the first intermediate rail, and a lower auxiliary rail connected between the lower portions of the pair of auxiliary rails and mounted on the recessed outer surface of the second intermediate rail; (c) a panel mounted on the outer surfaces of the upper rail and the first intermediate rail, respectively; (d) a panel mounted on the outer surface of the auxiliary frame; and (e) a panel mounted on the outer surfaces of the second intermediate rail and the lower rail, respectively, wherein the panels are spaced apart by a predetermined jointing space with one another.

According to the present invention having the above-mentioned aspect, since there is provided a framework having a plurality of frame portions and each of the frame portions has a panel mounted thereon thus forming a panel unit, mounting of one panel unit on the front surface of a building enables a plurality of panels to be mounted thereon at once so that, since the operations of assembling panel units and attaching sealing members between the panels can be previously conducted before mounting the panel units on the building body, these operations can be performed simply and readily, and also the reliability of the operations can be enhanced.

Further, since the outer surfaces of the first and second intermediate rails 4 and 5 are formed in a stepped shape, and the auxiliary frame B is mounted on the recessed inner portions of the rails 4 and 5, the auxiliary frame B can be mounted simply and readily on the latter, and also the outer surface of the auxiliary frame B can be located substantially flush with the outer portions on the outer surfaces of the intermediate rails 4 and 5 so that the panels mounted on the frame portions can be located substantially flush with one another.

The above-mentioned and other objects, aspects and advantages of the present invention will become apparent to those skilled in the art by making reference to the following detailed description taken in conjunction with the accompanying drawings in which preferred embodiments incorporating the principles of the present invention are shown by way of examples only.

DETAILED DESCRIPTION OF PREFERRED EMBODIMENTS

Figure 4:
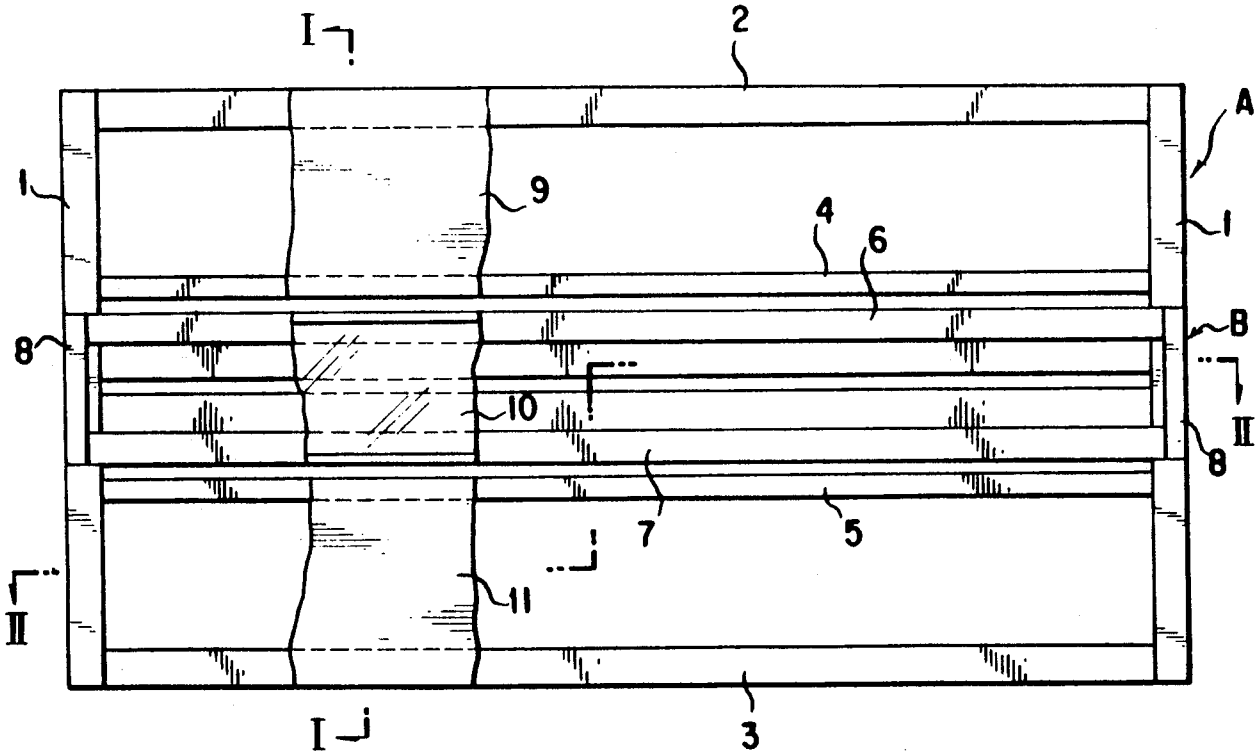
FIG. 4 is a front view of a framework of the embodiment shown in FIG. 1.

FIG. 4 is a front view of a main framework A, which comprises an upper rail 2, a lower rail 3, and upper and lower intermediate rails 4 and 5 extending transversely between the left and right stiles 1 and 1, thus forming a rectangular configuration, and an auxiliary frame B mounted between the upper and lower intermediate rails 4 and 5. The auxiliary frame B is a rectangular framework formed by an upper auxiliary rail 6, a lower auxiliary rail 7 and the left and right auxiliary stiles 8, 8.

Further, an aluminum panel 9 is mounted on a frame portion formed by the upper rail 2, the upper intermediate rail 4 and the left and right stiles 1, 1, a glass panel 10 is mounted on the auxiliary frame B, and an aluminum panel 11 is mounted on another frame portion formed by the lower intermediate rail 5, the lower rail 3 and the left and right stiles 1, 1. Thus, the three panels are mounted on one main framework A.

Figure 1:
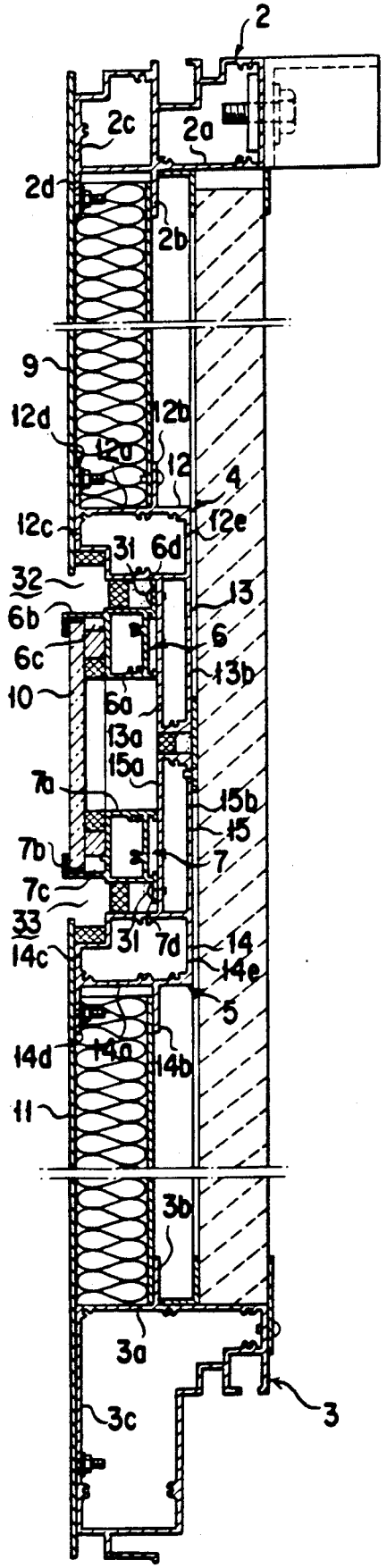
FIG. 1 is a schematic, longitudinal sectional view of a first embodiment of the present invention which is taken along line I—I in FIG. 4.

As shown in FIG. 1, the above-mentioned upper and lower rails 2 and 3 are of a substantially rectangular, hollow section. The inner surfaces 2*a* and 3*a* of the upper and lower rails 2 and 3 have inwardly directed pieces 2*b* and 3*b*, respectively, formed integrally therewith at substantially intermediate portions thereof between their inner and outer surfaces. The outer surfaces 2*c* and 3*c* of the upper and lower rail 2 and 3 are flush, and the outer surface 2*c* of the upper rail 2 projects inwardly from the inner surface 2*a* thereby forming a projecting piece 2*d* integrally therewith.

The above-mentioned upper intermediate rail 4 is comprised of a generally rectangular, hollow upper body 12, and a lower body 13 formed integrally with the inside, lower surface of the upper body 12. The upper body 12 has an upper surface 12*a* having a projecting piece 12*b* formed integrally therewith, and an outer surface 12*c* projecting upwardly from the upper surface 12*a* thus forming a projecting piece 12*d* integrally therewith. The outer surface 13*a* of the lower body 13 is located inside of the outer surface 12*c* of the upper body 12, and inner surfaces 12*e* and 13*b* are formed continuously and flush with each other, and the surface of the upper intermediate rail 4 is of a stepped shape recessed on the indoor side.

The above-mentioned lower intermediate rail 5 is comprised of a generally rectangular hollow lower body 14, and an upper body 15 formed integrally with the inside, upper surface of the lower body. The lower body 14 has a lower surface 14*a* having a projecting piece 14*b* formed integrally therewith, and an outer surface 14*c* projecting downwardly from the lower surface 14*a* thus forming a projecting piece 14*d* integrally therewith. The outer surface 15*a* of the upper body 15 is located inside of the outer surface 14*c* of the lower body 14, the inner surfaces 15*b* and 14*e* are formed continuously and flush with each other, and the outer surface of the lower intermediate rail 5 is of a stepped shape recessed on the indoor side. Thus, the lower intermediate rail 5 is in a vertically symmetrical relationship with the upper intermediate rail 4.

Figure 2:
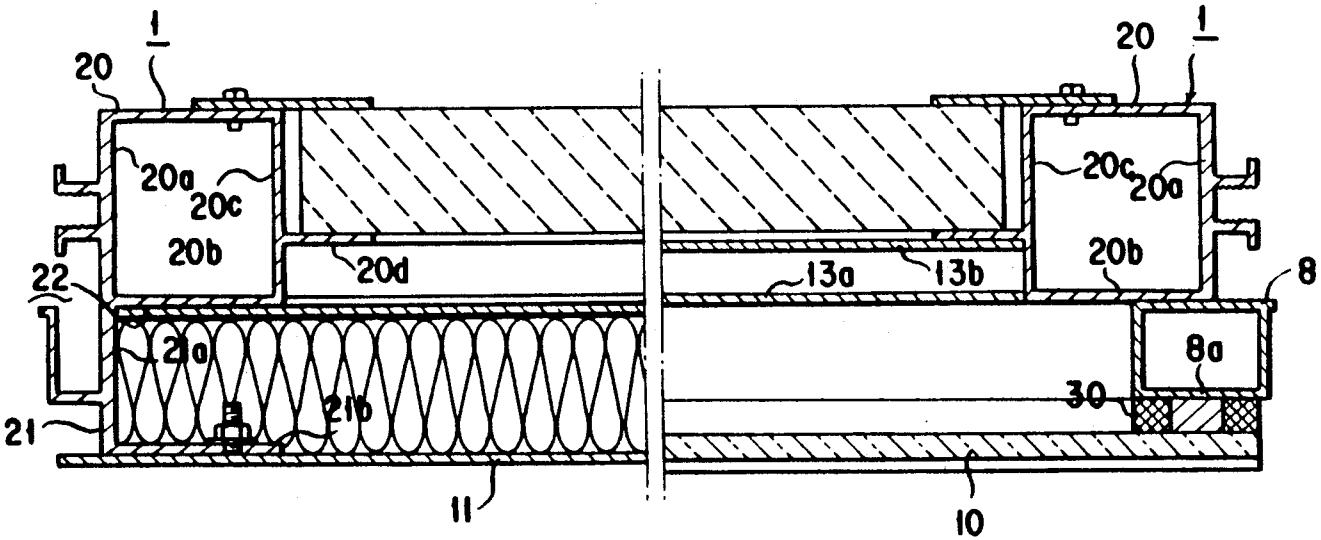
FIG. 2 is a schematic, cross-sectional view taken along line II—II in FIG. 4.

As shown in FIG. 2, each of the above-mentioned stiles 1 is comprised of a rectangular, hollow, inner body 20, and an outer plate 21. The outer plate 21 is an L-shape member which is formed by a projecting plate 21*a* and a mounting plate 21*b* and which forms an inward recess 22 together with an outer surface 20*b* of the inner body 20. The inner body 20 has an inner surface 20*c* having a projecting piece 20*d* formed integrally therewith.

Further, the upper and lower rails 2 and 3 are abutted against and connected to the inner surfaces of the stiles 1 in such a manner that the outer surfaces thereof 2*c* and 3*c* are located flush with the mounting plates 21*b*, and the inwardly turned pieces 2*b* and 3*b* are located flush with the outer surfaces 20*b* of the inner bodies 20. Moreover, the projecting pieces 20*d* of the inner bodies 20 are cut off at a portion thereof to be located opposite to the upper and lower rails 2 and 3.

The above-mentioned upper and lower intermediate rails 4 and 5 are abutted against and connected to the outer surfaces of the stiles 1 in such a manner that the outer surfaces 12*c* and 14*c* of the upper and lower bodies 12 and 14 are located flush with the mounting plates 21*b* of the stiles 1, and the inner surfaces thereof 12*e*, 13*b*, 14*e* and 15*b* are abutted against the projecting pieces 20*d* of the stiles 1 thereby positioning the stiles and the rails in a horizontal direction at right angles to the surface of the panels. Thus, the upper portions of the left and right stiles 1, 1, the upper rail 2 and the upper intermediate rail 4 form a rectangular framework having the aluminium plate 9 mounted on the outer surface thereof.

Stating more specifically, the aluminum plate 9 is fixedly secured by means of bolts to the mounting plates 21*b* of the stiles 1, the projecting plate 2*d* of the upper rail 2, and the projecting plate 12*d* of the upper intermediate rail 4.

The lower portions of the above-mentioned left and right stiles 1, 1, the lower rail 3, and the lower intermediate rail 5 form a rectangular framework having the aluminum plate 11 mounted on the outer surface thereof by means of bolts in the same manner as mentioned above.

As shown in FIG. 1, the auxiliary upper and lower rails 6 and 7 of the above-mentioned auxiliary frame B comprise hollow bodies 6*a* and 7*a* having hook-shaped support pieces 6*b* and 7*b*, respectively, formed integrally therewith thus forming inward recesses 6*c* and 7*c*, and also having mounting pieces 6*d* and 7*d*, respectively, formed integrally therewith. The above-mentioned auxiliary stile 8 is rectangular and hollow as shown in FIG. 2, and the inner surface of the auxiliary stile 8 is connected to the upper and lower auxiliary rails 6 and 7 thus forming the auxiliary frame B as shown in FIG. 4. The upper and lower edges of the glass plate 10 are supported by the inward recesses 6*c* and 7*c*, and the left and right edges of the glass plate 10 are adhesively bonded and secured through structural seals 30 to the outer surfaces 8*a* of the auxiliary stiles 8, and each of the auxiliary stiles 8 is covered by the glass plate 10 so that it cannot be seen from the outdoor side.

Further, the outer mounting plates 21 of the left and right stiles 1 are partially cut off at their vertically intermediate portions, respectively, through the cut-off portions of which the auxiliary frame B is mounted.

Figure 3:
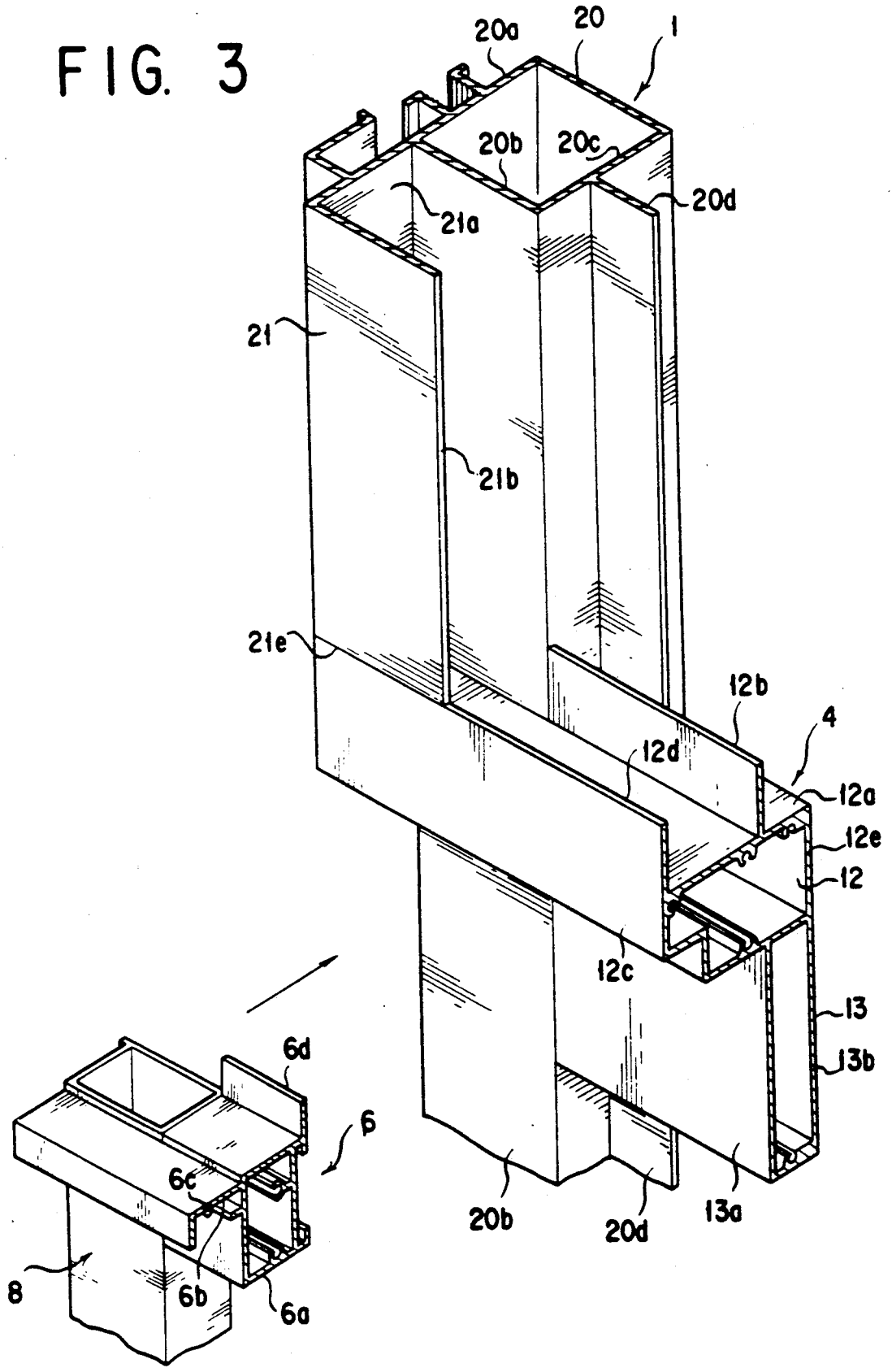
FIG. 3 is an exploded view showing a fragmentary perspective view of a connecting portion of a stile and a rail of the embodiment shown in FIG. 1, in combination with a fragmentary perspective view of a connecting portion of an auxiliary stile and an auxiliary rail of the same embodiment.

Stating in brief, the cut-off end faces 21*e* of the outer mounting plates 21 are identical in shape to the outdoor side upper surface of the upper intermediate rail 4 and the outdoor side lower surface of the lower intermediate rail 5, and the former are connected to the latter as shown in FIG. 3. The auxiliary frame B is inserted between the upper and lower intermediate horizontal members 4 and 5, and the mounting pieces 6*d* and 7*d* of the upper and lower auxiliary rails 6 and 7 are mounted on the outer surfaces 13*a* and 15*a* of the lower and upper bodies 13 and 15, respectively, by means of screws 31. A jointing space 32 is formed between the upper body 12 and the upper auxiliary rail 6, whilist a jointing space 33 having the same lateral width as that of the jointing space 32 is formed between the lower auxiliary rail 7 and the lower intermediate rail 5 so that the screws 31 may be tightened through the jointing spaces 32 and 33, respectively. Further, the outer surface 8*a* of the auxiliary stile 8 is located substantially flush with the end face of the glass plate 10.

Figure 5:
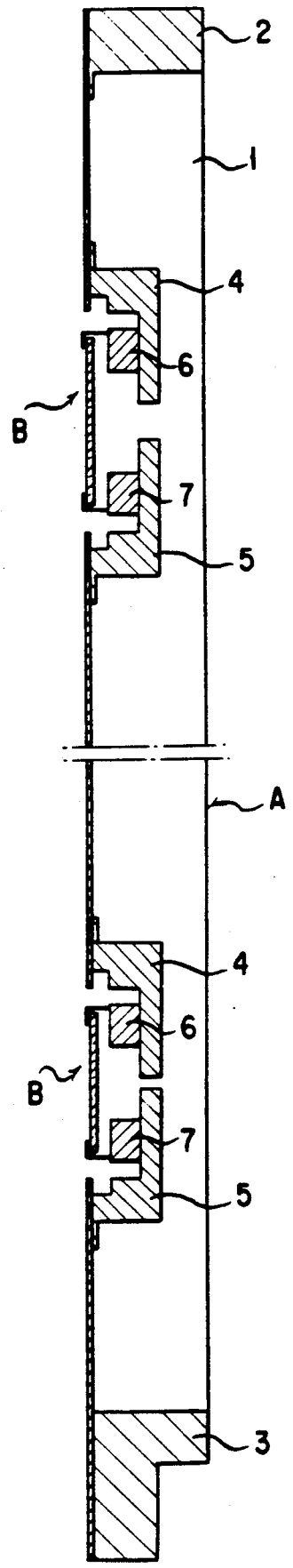
FIG. 5 a schematic, longitudinal sectional view of a modified embodiment of the present invention.
Figure 6:
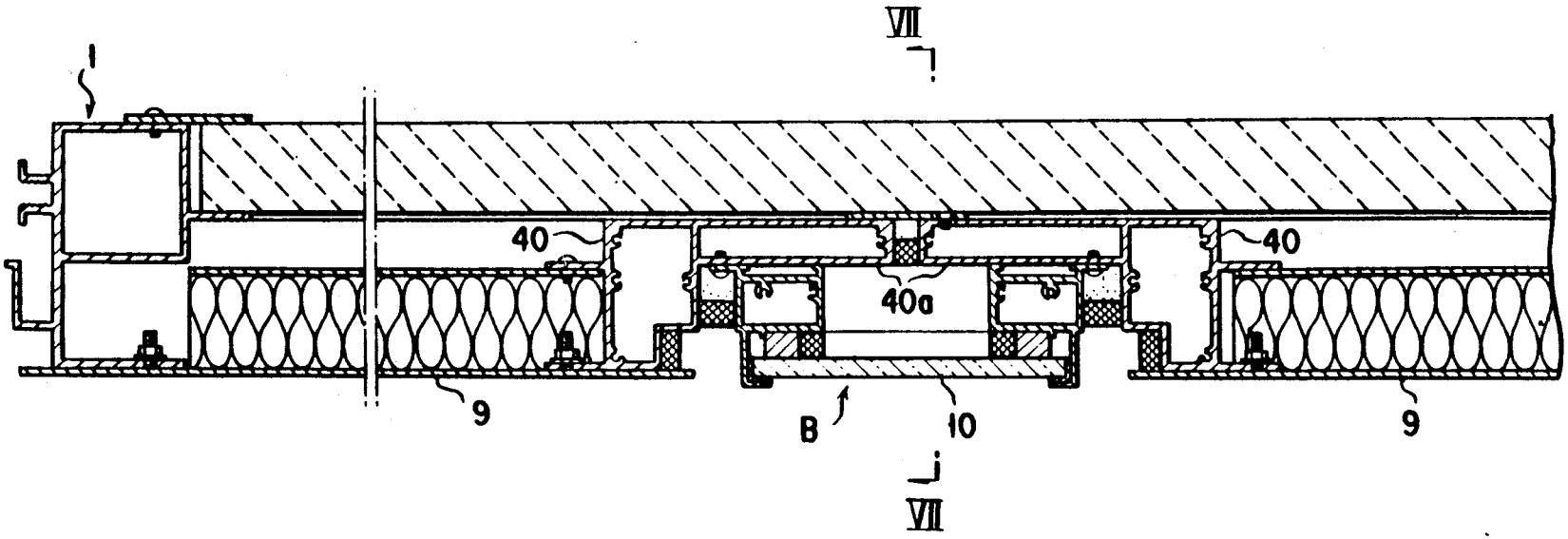
FIGS. 6 and 7 and are a schematic cross-sectional view of a second embodiment of the present invention and a longitudinal sectional view taken along line VII—VII in FIG. 6.
Figure 7:
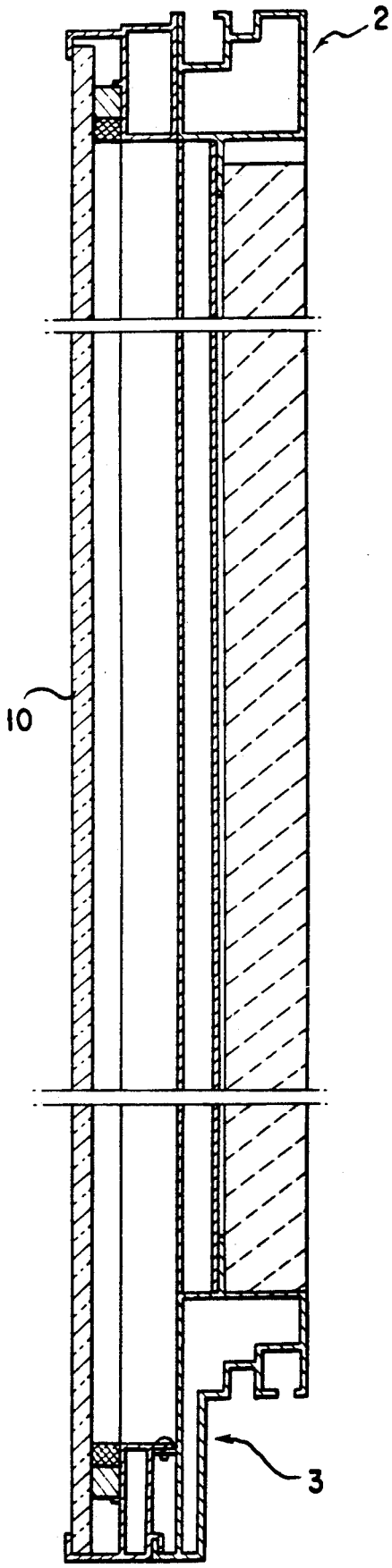

Further, as shown in FIG. 5, it is possible to mount a plurality of pair of transversely extending upper and lower intermediate horizontal members 4 and 5, each having an auxiliary frame B mounted thereon, between the left and right stiles 1 and 1, and mount such pairs on the framework A, or alternatively as shown in FIGS. 6 and 7, it is possible to mount vertically left and right intermediate stiles 40, 40, which have stepped outdoor-side surfaces recessed on the indoor side in their respective opposed portions to each other, respectively, between the upper and lower rails 2 and 3, and mount the auxiliary frame B between the inner portions 40*a*, 40*a* of the left and right intermediate stiles 40, 40.

It is to be understood that the foregoing description is merely illustrative of preferred embodiments of the present invention, and that the scope of the invention is not to be limited thereto, but is to be determined by the scope of the appended claims.

What is claimed is:

1. A panel unit comprising:

a plurality of first frame means and second frame means formed by dividing a main framework, assembled in rectangle, by means of intermediate cross members;

first panel means mounted on respective outdoor sides of some of said first frame means so as to form outdoor-side panel surfaces flushed with one another;

said second frame means each having a recessed portion recessed from the outdoor side toward the indoor side relative to said panel surfaces;

auxiliary frame means each being mounted to said recessed portion; and second panel means mounted on respective front surface sides of said auxiliary frame means so as to form a smooth flush surface with said panel surfaces of the first panel means;

wherein predetermined jointing spaces having equal lateral widths to one another are formed between respective panel means adjacent to each other forming selected spacial gaps in said flush surface.

2. A panel unit as set forth in claim 1 wherein said main framework comprises left and right stiles extending vertically and spaced apart from each other and said first frame means comprises a pair of upper and lower rails respectively connected horizontally between respective upper and lower portions of said pair of left and right stiles, and said second frame means comprises a pair of intermediate vertical members being respectively connected vertically by a predetermined space between said pair of upper and lower rails and being provided with stepped portions, respectively, having recessed outdoor-side surfaces at their respective opposite portions, forming said recessed portions.

3. A panel unit as set forth in claim 2, wherein said second panel means comprises a window panel, and said auxiliary frame is removably mounted into said recessed portion by the use of fasteners.

4. A panel unit as set forth in claim 2, wherein said first and second intermediate horizontal members comprise an L-shaped boxed tubular members.

5. A panel unit as set forth in claim 1, wherein:

said main framework comprises a pair of left and right stiles extending vertically in parallel relationship to and spaced horizontally apart from each other; and said plurality of first frame means comprises a pair of upper and lower rails connected horizontally between respective upper portions of said stiles and between respective lower portions thereof, respectively; and said plurality of second frame means comprises a pair of first and second intermediate horizontal members respectively connected horizontally between said pair of left and right stiles and at vertically substantially intermediate positions between said upper and lower rails, respective outdoor-side surfaces of said first and second intermediate rials having outdoor-side surfaces located opposite to and substantially flush with respective outdoor-side surfaces of said upper and lower rails, respectively, and recessed outdoor-side surfaces recessed toward the indoor side and located opposite to each other, respectively, forming said recessed portions, (b) said auxiliary frame means comprises a rectangular auxiliary frame formed by a pair of left and right auxiliary stiles located on the outdoor-side surfaces of said pair of left and right stiles, respectively; an upper auxiliary rail connected between respective upper portions of said pair of auxiliary stiles and mounted to the recessed outdoor-side surface of said first intermediate rail; and a lower auxiliary rail connected between respective lower portions of said pair of auxiliary rails and mounted to the recessed outdoor-side surface of said second intermediate rail, (c) said first panel means comprises a panel mounted over the respective outdoor-side surfaces of said upper rail and said first intermediate rail, and a panel mounted over the respective outdoor-side surfaces of said second intermediate rail and said lower rail, (d) said second panel means comprises a panel mounted over the outdoor-side surfaces of said auxiliary frame, and (e) respective adjacent first and second panel means are spaced apart from one another by predetermined jointing spaces, respective, each having an equal lateral width.

6. A panel unit as set forth in claim 5, wherein said first and second intermediate horizontal members comprise and L-shaped boxed tubular members.

7. A panel unit comprising:

a plurality of first frame means and second frame means formed by dividing a main framework, assembled in rectangle, by means of intermediate cross members;

wherein said main framework comprises left and right stiles extending vertically and spaced apart from each other and said first frame means comprises a pair of upper and lower rails respectively connected horizontally between respective upper and lower portions of said pair of left and right stiles, and said second frame means comprises a pair of intermediate vertical members being respectively connected vertically by a predetermined space between said pair of upper and lower rails and being provided with stepped portions, respectively, having recessed outdoor-side surfaces at their respective opposite portions, forming recessed portions outdoor side toward the indoor side relative to said panel surfaces;

first panel means mounted on a respective outdoor side of some of said first frame means so as to form outdoor-side panel surfaces flushed with one another;

auxiliary frame means each mounted to said recessed portion and said auxiliary frame is removably mounted into said recessed portion by the use of fasteners;

second panel means comprising window panels, mounted on respective front surface sides of said auxiliary frame means so as to form smooth surfaces flushed with said panel surfaces of the first panel means;

wherein predetermined jointing spaces having equal lateral widths to one another are formed between respective panel means adjacent to each other; and wherein said fasteners are accessible for installation and removal through said predetermined jointing spaces.

8. A panel unit comprising:

a plurality of first frame means and second frame means formed by dividing a main framework, assembled in rectangle, by means of intermediate cross members;

first panel means mounted on a respective outdoor side of some of said first frame means so as to form outdoor-side panel surfaces flushed with one another;

said second frame means each having a recessed portion recessed from the outdoor side toward the indoor side relative to said panel surfaces;

auxiliary frame means mounted to said recessed portion; and second panel means mounted on respective front surface sides of said auxiliary frame means so as to form smooth surfaces flushed with said panel surfaces of the first panel means;

wherein predetermined jointing spaces having equal lateral widths to one another are formed between respective panel means adjacent to each other, said main framework comprises a pair of left and right stiles extending vertically in parallel relationship to and spaced horizontally apart from each other, and said plurality of first frame means comprises a pair of upper and lower rails connected horizontally between respective upper portions of said stiles and between respective lower portions thereof, respectively, and said plurality of second frame means comprises a pair of first and second intermediate horizontal members respectively connected horizontally between said pair of left and right stiles and at vertically substantially intermediate positions between said upper and lower rails, respective outdoor-side surfaces of said first and second intermediate rials having outdoor-side surfaces located opposite to and substantially flush with respective outdoor-side surfaces of said upper and lower rails, respectively, and recessed outdoor-side surfaces recessed toward the indoor side and located opposite to each other, respectively, forming said recessed portions;

said auxiliary frame means comprises a rectangular auxiliary frame formed by a pair of left and right auxiliary stiles located on the outdoor-side surfaces of said pair of left and right stiles, respectively, an upper auxiliary rail connected between respective upper portions of said pair of auxiliary stiles and mounted to the recessed outdoor-side surface of said first intermediate rail, and a lower auxiliary rail connected between respective lower portions of said pair of auxiliary rails and mounted to the recessed outdoor-side surface of said second intermediate rail;

said first panel means comprises a panel mounted over the respective outdoor-side surfaces of said upper rail and said first intermediate rail, and a panel mounted over the respective outdoor-side surfaces of said second intermediate rail and said lower rail;

said second panel means comprises a panel mounted over the outdoor-side surfaces of said auxiliary frame; and respective adjacent first and second panel means are spaced apart from one another by predetermined jointing spaces, respective, each having an equal lateral width; and wherein said second panel means comprises a window panel, and said auxiliary frame is removably mounted into said recessed portion by the use of fasteners.

9. A panel unit as set forth in claim 8, wherein said fasteners are accessible for installation and removal through said predetermined jointing spaces.

10. A panel unit comprising:

a left stile;

a right stile, said left stile and said right stile arranged spaced apart in side-by-side, vertical orientation, said left stile and said right stile each having upper and lower mounting plates having outside facing surfaces, and a central recessed outer surface arranged contiguously lengthwise between said mounting plates, said upper and lower mounting plates having outside surfaces flush with each other;

an upper rail;

a lower rail, said upper rail and said lower rail arranged horizontally spaced apart from each other, and connecting said left stile to said right stile in a rectangular fashion, said upper rail and said lower rail having horizontal mounting surfaces flush with said outside facing surfaces of said mounting plates;

an upper intermediate rail;

a lower intermediate rail, said intermediate rails arranged horizontally between said upper and lower rails, said upper intermediate rail and said lower intermediate rail having L-shaped boxed configurations, said upper intermediate rail having an upper mounting surface flush with said outside facing surfaces of said upper mounting plates of said left and right stiles, and having a lower mounting surface flush with said central recessed outer surfaces of said left and right stiles, said lower intermediate rail having a lower mounting surface flush with said outside facing surfaces of said lower mounting plates of said left and right stiles and an upper mounting surface flushed with said central recessed outer surfaces of said left and right stiles, said upper and lower intermediate rials connecting said left and right stiles with said upper mounting surface of said upper intermediate rail and said lower mounting surface of said lower intermediate rail contiguous with said outside facing surfaces of said upper and lower mounting plates respectively, and said lower mounting surface of said upper intermediate rail and said upper mounting surface of said lower intermediate rail contiguous with said central recessed outer surface of said left and right stiles;

a first panel mounted across said left stile and said right stile, mounted to said upper mounting surface of said upper intermediate rail and said upper mounting plates of said left and right stiles and mounted to said horizontal mounting surface of said upper rail;

a second panel mounted across said left stile and said right stile, mounted to said lower mounting surface of said lower intermediate rail and said lower mounting plates of said left and right stiles and mounted to said lower rail;

a window panel;

an auxiliary frame for holding said window panel therein, said auxiliary frame having an upper auxiliary rail and a lower auxiliary rail each of said auxiliary rails having inwardly directed hook-shaped support pieces for holding said window panel between said upper auxiliary rail and said lower auxiliary rail, said auxiliary frame mounted to said lower mounting surface of said upper intermediate rail and said upper mounting surface of said lower intermediate rail and said central recessed outer surfaces of said left stile and said right stile, said auxiliary frame adapted to hold said window panel outward from said left stile and said right stile for said window panel to be arranged flushly with said first panel and said second panel, and said auxiliary frame and said window panel are adapted to have a height allowing for a selected gap between said window panel and each of said first panel and said second panel.

11. The panel unit of claim 10, wherein said auxiliary frame provides fastener lugs outwardly of said hook-shaped support pieces to hold fasteners for fastening the lugs to the lower mounting surface of the upper intermediate rail and the upper mounting surface of the lower intermediate rail, said fasteners accessible through said selected gap.

* * * * *